US005230182A

United States Patent [19]

Daniell et al.

[11] Patent Number: 5,230,182

[45] Date of Patent: Jul. 27, 1993

[54] APPARATUS FOR OPTICAL MATERIALS FABRICATION BY ULTRASONIC MACHINING

[75] Inventors: Keith Daniell, E. Norwalk; Matthew B. Magida, Southbury; Steven Chuang, Newtown; Joann Magner, Danbury; D. P. Mathur, Newtown, all of Conn.

[73] Assignee: Hughes Aircraft Company, Los Angeles, Calif.

[21] Appl. No.: 922,910

[22] Filed: Jul. 31, 1992

[51] Int. Cl.[5] ..... B24B 1/04

[52] U.S. Cl. ..... 51/59 SS; 51/317

[58] Field of Search ..... 51/59 SS, 317, 284 R

[56] References Cited

U.S. PATENT DOCUMENTS

| | | | |
|---|---|---|---|
| 2,791,066 | 5/1957 | Mahlmeister | 51/59 SS |
| 2,804,724 | 9/1957 | Thatcher | 51/59 SS |
| 2,939,252 | 6/1960 | Cooke | 51/59 SS |
| 4,934,103 | 6/1990 | Campergue et al. | 51/59 SS |
| 5,136,815 | 8/1992 | Kramarenko et al. | 51/59 SS |

FOREIGN PATENT DOCUMENTS

| | | | |
|---|---|---|---|
| 1146647 | 6/1989 | Japan | 51/59 SS |

*Primary Examiner*—Robert A. Rose

*Attorney, Agent, or Firm*—Michael W. Sales; Wanda K. Denson-Low

[57] ABSTRACT

A slurry of abrasive particles 17 is placed on the surface of an optic material 28. A tool tip 16 driven by an ultrasonic transducer 12 is immersed in the slurry 17 where it is used to ultrasonically vibrate the particles in the slurry 17. The vibration of the abrasive particles causes matter removal from the surface of the optic material 28 by abrasion. The tool tip 16 is moved relatively over the surface of the material 28 by moving a precision translation stage 18 having the material 28 mounted thereon so as to machine the surface thereof.

17 Claims, 2 Drawing Sheets

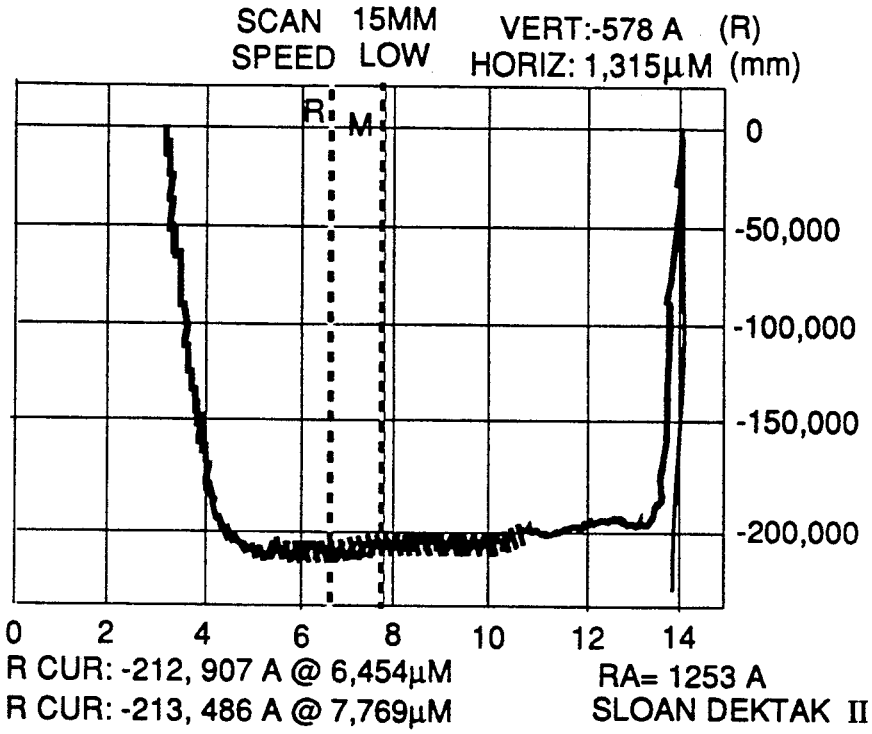
FIG. 3a
FIG. 3 b.
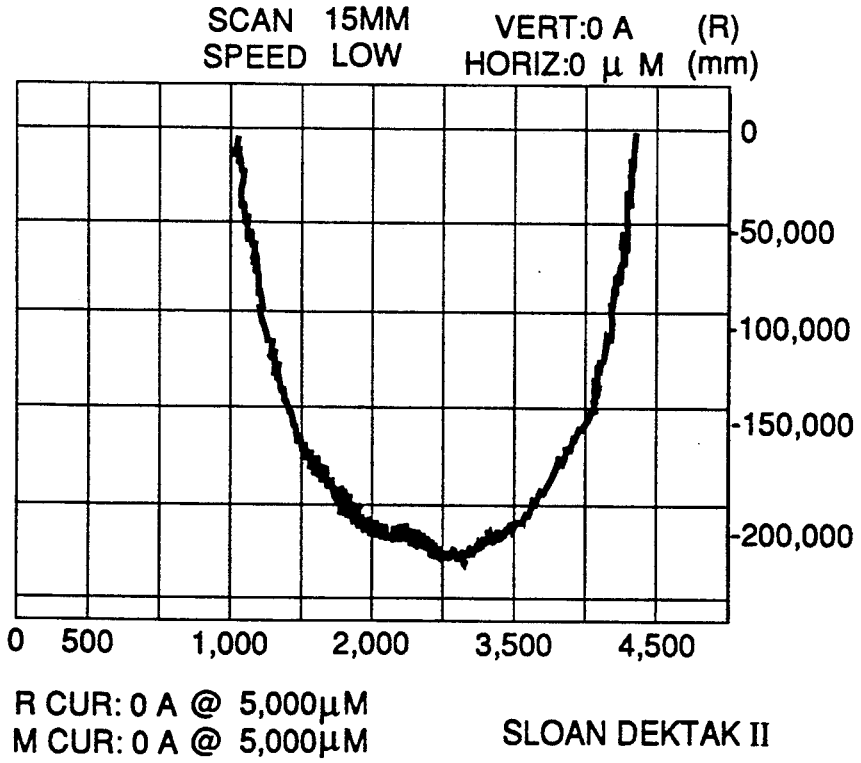

APPARATUS FOR OPTICAL MATERIALS FABRICATION BY ULTRASONIC MACHINING

FIELD OF THE INVENTION

The present invention relates to an apparatus for fabricating optical materials utilizing ultrasound, and more particularly to an apparatus for fabricating optical materials by removing matter from an optical surface by ultrasonic machining in a controlled manner so as to create a smooth surface.

DESCRIPTION OF THE PRIOR ART

Optical surfaces fabricated from optical materials using conventional surface treatment techniques such as grinding and lapping present undesirable limitations, including severe surface slopes, resulting in misfits, sub-surface damage and non-uniformity, when generating fast, aspheric optics having little subsurface damage thereon.

Ultrasonic machining has been used extensively for machining ceramics and other brittle materials. Most of the emphasis in ultrasonic machining work is on rapid material removal and generation of complex shapes with slurries consisting of large particles (particles greater than 10 microns) which generate surface roughness and subsurface damage consistent with the particle size used. Thus, conventional ultrasonic machining which employ large slurry particles provides less control over the final figure of an optic and also results in an optic with higher roughness values. Ultrasonic processes have been used to treat optical surfaces. The use of localized static ultrasonic machining as a finishing stage has been disclosed in A. K. Zimin, A. V. Savel'ev, and V. M. Chutko, "Use of Ultrasonic Processing for the Fabrication of Optical Components Having a Complicated Surface Shape", 53 *Soviet Journal Optics Technology*, pgs 55 and 56 (1986), and A. K. Zimin, "Investigation of the Technological Process of Ultrasonic Finishing of Polished Surfaces of Optical Elements", 57 *Soviet Journal of Optics Technology*, pgs 309–311 (1990).

Thus, the present invention improves upon the prior art conventional and ultrasonic methods and apparatus by providing an apparatus which can machine as well as smooth an optical surface rapidly.

SUMMARY OF THE INVENTION

The present invention is a method and apparatus for ultrasonic fabrication of optical surfaces. The apparatus provides an ultrasonic tool which can rapidly machine the surface of an optical material. The surface is machined by passing the surface relative to a tip of the tool immersed in a slurry of abrasive particles. The tool causes vibrations of the abrasive particles in the slurry which in turn controllably and smoothly removes matter from the optical surface by abrasion. The present invention also provides a counter balanced translation stage assembly to adjust the impact of the force from the tool to the material when a narrow gap is used between the tool tip and the optic surface.

One objective of the present invention is to provide a tool for fabricating optical materials with reduced subsurface damage.

Another objective of the present invention is to provide a tool for fabricating optical materials which has the capability of generating aspheric shapes.

Another objective of the present invention is to provide a tool for fabricating optical materials with high material removal rates.

Other objects and advantages will become apparent to those skilled in the art from the following detailed description read in conjunction with the attached drawings and the claims appended hereto.

DESCRIPTION OF THE DRAWINS

FIG. 3*a* is a graph of the depth of a trench along the length of the trench which was machined by the present invention.

FIG. 3*b* is a graph of the same trench along the width of the trench.

Figure 4:
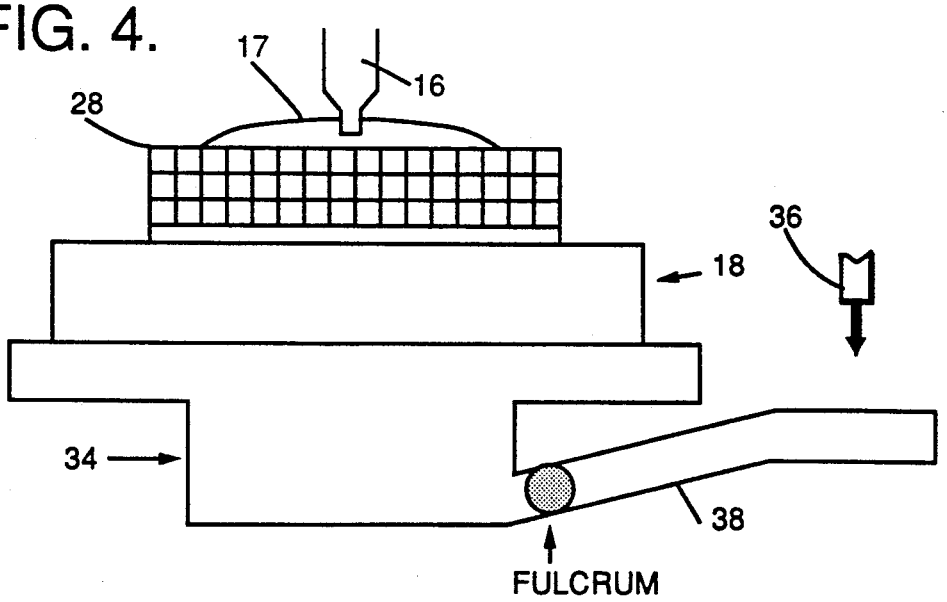

FIG. 4 is a schematic diagram of another embodiment of the present invention showing the incorporation of a counterbalanced translation stage.

DETAILED DESCRIPTION OF THE PRESENT INVENTION

Figure 1:
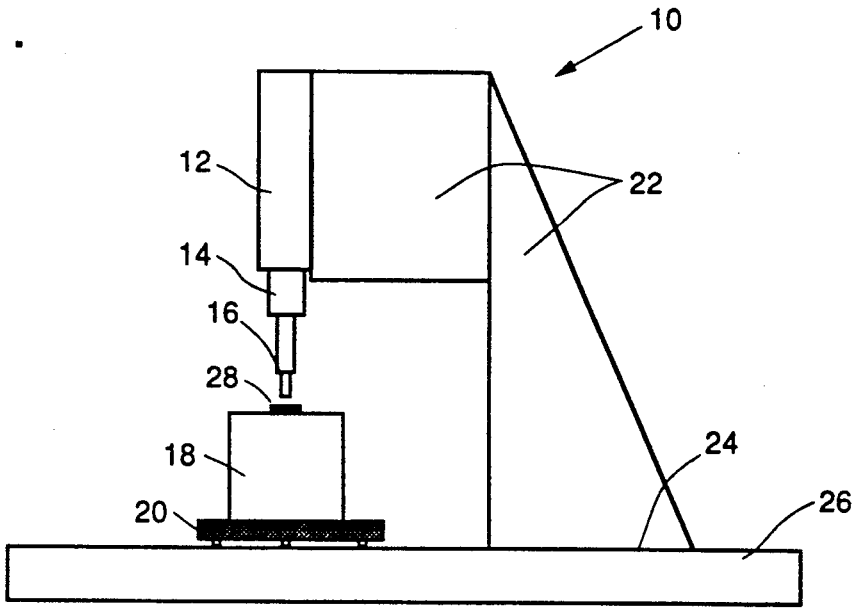
FIG. 1 is a schematic diagram of one embodiment of an ultrasonic machining tool of the present invention.

The present invention relates to an ultrasonic machining tool for the fabrication of optics from optical materials. FIG. 1 generally illustrates one embodiment of the ultrasonic machining tool of the present invention wherein the tool 10 comprises an ultrasonic transducer 12, a booster 14 connected to the transducer 12, a tool tip 16 connected to said booster 14, and a precision multi-dimensional translation stage 18 mounted to a precision trivet 20. The transducer, booster and tool are suspended above the precision stage and trivet by a rigid support assembly 22 affixed to the transducer. The base 24 of the support assembly 22 is firmly attached to a bench 26 which also supports the trivet 20 and the precision translation stage 18 under the tool tip 16. The placement of a multi-dimensional translation stage, comprising two Newport 430 micrometer adjustable stages (Y and Z direction) and a Newport 430 stage using a Newport model 850 actuator (X direction), under the tool tip of a Branson UAM-10 ultrasonic drill has been found to perform satisfactorily for the purposes of ultrasonic machining of optical surfaces. Circular tool tips 16 ranging from 1 to 3 mm in diameter, machined from 304 stainless steel and polished flat to a sub-micron root-mean-square (RMS) roughness have been found to adequately perform as tool tips 16 needed for the present invention. Although specific apparatus has been described as performing adequately for the purposes of the present invention, the use of other ultrasonic drill apparatus and translation stages will not deviate from the spirit of the present invention.

Figure 2:
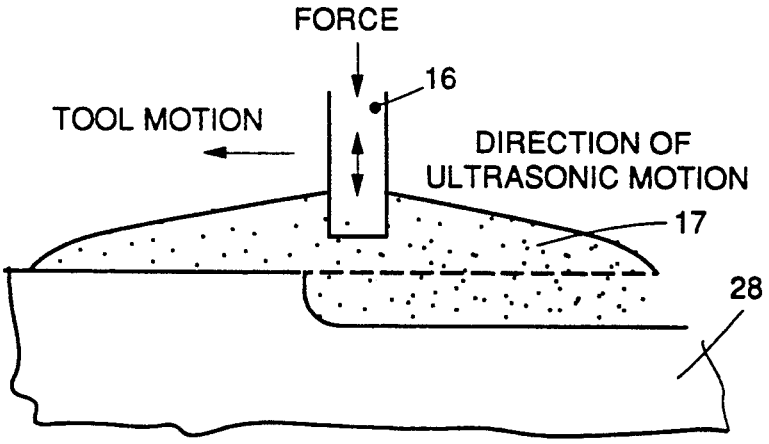
FIG. 2 is a schematic diagram of the tool tip of the ultrasonic machining tool of the present invention and illustrates the relative position of the tool tip with respect to the optical material surface and slurry.

Generally, the ultrasonic machining of an optical material into a smooth optic is performed by affixing the material 28 to the precision translation stage 18 and passing the tool tip 16 immersed in a slurry 17 of abrasive particles over the surface of said material 28 where machining is desired. FIG. 2 illustrates the position of the tool tip 16 relative to an optic material 28 surface undergoing ultrasonic machining. During the ultrasonic machining process of the present invention, the immersion of the tool tip 16 in the slurry 17 of abrasive particles covering the optic material surface 28 causes the abrasive particles to collide with the optic material surface. The collisions between the abrasive particles of the slurry 17 and the optic material surface cause material removal from the surface by abrasion. Thus, by moving the tool tip 16 in a slurry 30 over the surface of the optic, the entire surface of the optic can be machined. A slurry of thirty to fifty percent by volume cubic boron nitride (0–2 microns) or aluminum oxide (alumina) particles suspended in water or oil can be used as an abrasive slurry for the purposes of the present invention. When an oil based slurry is used, it is preferable to use a synthetic vacuum oil (AA #SVL-30) for its reduced reactivity and vapor pressure.

FIGS. 3*a* and 3*b* illustrate graphic profiles taken along the length and width of a trench machined into a surface of a fused silica optic with the present invention. The graphic profiles illustrated in FIGS. 3*a* and 3*b* were made with a DekTak II mechanical profilometer utilizing a 12 micron (radius) stylus. The accuracy of the DekTak II mechanical profilometer has been determined to be in the range of ±25 Å. The profiles shown in FIGS. 3*a* and 3*b* were generated by maintaining a gap of a couple of microns between the surface of the optic and a 3 mm tool tip 16. The machining was performed in a water based slurry of 30 percent by volume of 5 micron alumina particles. The ultrasonic transducer was run at approximately 30 watts while the velocity of the optic surface relative to the tool tip was maintained at approximately 0.1 mm/s. Thus, as shown in FIGS. 3*a* and 3*b*, at a velocity of 0.1 mm/s, the average depth of a trench was 20 μm and had a average roughness of 0.1 μm. The removal rate calculated for the trench machined by the ultrasonic machining tool of the present invention was $6\times10^3$ $mm^3/s$.

While machining can be performed with the embodiment described above, in some cases problems with maintaining a gap between the tool tip 16 and the surface of the optic may occur, primarily caused by the force exerted by the tool tip 16 on the surface of the optic resting on the precision multi-dimensional translation stage 18 during the machining process. The force can cause the optic material to tilt so that the surface of the optic material actually contacts the tool tip. In some cases better machining results are achieved by reducing the gap between the tool tip and the optical material surface so that there is actually a spring loading of the optic material surface against the tool tip 16. However, under these conditions increased tool tip damage can be experienced.

Another embodiment of the present invention, illustrated in FIG. 4, is designed to allow spring loading of the optical material surface while reducing the tool tip damage. The precision translation stage 18 is placed on a counter-balance stage 34 and is balanced by a weight 36 placed on the opposite side of the fulcrum of a lever arm 38. The weight 36 is used to counter balance the weight of the optical material 28, the translation stage 18 and the force exerted on the optical material surface by the tool tip 16. Thus, by adjusting the translational stage force to maintain a proper gap between the tool tip and the optical material surface, a reduction in tool damage can be accomplished. However, reducing the amplitude of tool motion can reduce the average material removal rate.

Thus, by using very small abrasive particles together with a counter-balance stage during the ultrasonic machining process, the method and apparatus can ultrasonically machine an optic material surface so as to fabricate a precision optic having little subsurface damage thereon. The invention as described above admirably achieves the objects of the invention; however, it will be appreciated that departures can be made by those skilled in the art without departing from the spirit and scope of the invention, which is limited only by the following claims.

What is claimed is:

1. An apparatus for performing ultrasonic machining of a surface of an optical material to remove matter from the surface thereof smoothly and precisely, said apparatus comprising:

an ultrasonic transducer;

a slurry of abrasive particles on the surface of said optical material;

a tool for directing ultrasonic vibrations from said ultrasonic transducer to the slurry on the surface of said optical material;

a coupler coupling said ultrasonic transducer and said tool so as to direct ultrasonic vibrations from said ultrasonic transducer to said tool;

a multi-dimensional translation stage positioned proximal to said tool so as to provide a movable platform for holding said optical material in the vicinity of said tool; and means for counterbalancing a force exerted by said tool on the surface of said optical material, said counterbalancing means including means for supporting said multi-dimensional translation stage on a counterbalance stage.

2. The apparatus of claim 1, wherein the slurry comprises cubic boron nitride particles dispersed in water.

3. The apparatus of claim 2, wherein the content of cubic boron nitride particles is in the range of 30 to 50 percent by volume.

4. The apparatus of claim 2, wherein the size of the cubic boron nitride particles ranges from zero to five microns.

5. The apparatus of claim 1, wherein the slurry comprises cubic boron nitride particles dispersed in oil.

6. The apparatus of claim 5, wherein the content of the cubic boron nitride particles is in the range of 30 to 50 percent by volume.

7. The apparatus of claim 5, wherein the size of the cubic boron nitride particles ranges from zero to five microns.

8. The apparatus of claim 1, wherein the slurry comprises aluminum oxide particles dispersed in water.

9. The apparatus of claim 8, wherein the content of the particles is in the range of 30 to 50 percent by volume.

10. The apparatus of claim 8, wherein the size of the particles is in the range of zero to five microns.

11. The apparatus of claim 1, wherein the slurry comprises aluminum oxide particles dispersed in oil.

12. The apparatus of claim 11, wherein the content of the particles is in the range of 30 to 50 percent by volume.

13. The of apparatus claim 11, wherein the size of the particles is in the range of zero to five microns.

14. The apparatus of claim 1, wherein the tool is fabricated from 304 stainless steel.

15. The apparatus of claim 1, wherein the tool is cylindrical.

16. The apparatus of claim 15, wherein the diameter of said cylindrical tool is in the range of 1 to 3 mm.

17. An apparatus for performing ultrasonic machining of a surface of an optical material so as to remove matter from the surface smoothly and precisely, said apparatus comprising:

an ultrasonic transducer;

a slurry of abrasive particles on the surface of said optical material;

a tool for directing ultrasonic vibrations from said ultrasonic transducer to the slurry on the surface of said optical material;

a coupler inserted between said ultrasonic transducer and said tool so as to direct ultrasonic vibrations from said ultrasonic transducer to said tool;

a counter balancing platform so as to provide a means for counterbalancing a force exerted by said tool on the surface of said optical material; and a multi-dimensional translation stage supported by said counter balancing platform and positioned proximal to said tool so as to provide a movable platform for holding said optical material in the vicinity of said tool.

* * * * *